US010814635B2

(12) United States Patent
Sivaraman et al.

(10) Patent No.: US 10,814,635 B2
(45) Date of Patent: Oct. 27, 2020

(54) INKJET REUSABLE JETTING SHEET WITH CLEANING STATION

(71) Applicant: Xerox Corporation, Norwalk, CT (US)

(72) Inventors: Senthil Sivaraman, Webster, NY (US); Ali R. Dergham, Fairport, NY (US); Richard A. Campbell, Rochester, NY (US); Glenn D. Batchelor, Fairport, NY (US); Robert A. Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/355,891

(22) Filed: Mar. 18, 2019

(65) Prior Publication Data

US 2020/0298573 A1 Sep. 24, 2020

(51) Int. Cl.
*B41J 2/165* (2006.01)

(52) U.S. Cl.
CPC ..... *B41J 2/16544* (2013.01); *B41J 2/16505* (2013.01); *B41J 2/16541* (2013.01); *B41J 2002/1655* (2013.01); *B41J 2002/16582* (2013.01)

(58) Field of Classification Search
CPC ..... B41J 2002/1655; B41J 2002/16582; B41J 2/16505; B41J 2/16544; B41J 2/16508; B41J 2/16511; B41J 2/16541
See application file for complete search history.

(56) References Cited

U.S. PATENT DOCUMENTS

| | | | | |
|---|---|---|---|---|
| 4,369,456 | A * | 1/1983 | Cruz-Uribe | B41J 2/16535 347/19 |
| 5,617,124 | A | 4/1997 | Taylor et al. | |
| 5,805,182 | A | 9/1998 | Lee | |
| 6,213,583 | B1 | 4/2001 | Therien | |
| 6,299,279 | B1 | 10/2001 | Asada | |
| 6,318,838 | B1 | 11/2001 | Anderson et al. | |
| 6,340,220 | B1 | 1/2002 | Gaylor et al. | |
| 6,523,932 | B2 | 2/2003 | Johnson | |
| 6,860,583 | B2 | 3/2005 | Cheney et al. | |
| 8,382,242 | B2 | 2/2013 | Rosati et al. | |

(Continued)

OTHER PUBLICATIONS

Kureha Elastomer Co., Ltd., Ultra-Thin Rubber Sheet "Pera-Pera-Kun" http://www.kurehae.co.jp/en/products/perapera.html. Accessed on Nov. 28, 2018, pp. 1-3.

*Primary Examiner* — Henok D Legesse
(74) *Attorney, Agent, or Firm* — Gibb & Riley, LLC

(57) ABSTRACT

Devices include one or more inkjet printheads, a reusable jetting sheet that is adjacent to nozzles of the printheads, support structures (e.g., drive rollers) contacting the sheet, and a cleaning station contacting the sheet. The reusable jetting sheet includes an opening, that is at least as large as the sets of nozzles, and a jetting area spaced from the opening. The support structures are adapted to move the reusable jetting sheet relative to the sets of nozzles. The inkjet printheads are adapted to eject ink from at least some of the nozzles, through the opening, to print media when the opening is positioned adjacent to the sets of nozzles, to print on print media. The inkjet printhead is further adapted to eject ink from at least some of the nozzles to the jetting area when the jetting area is positioned adjacent to the sets of nozzles to perform maintenance jetting.

19 Claims, 8 Drawing Sheets

(56) References Cited

U.S. PATENT DOCUMENTS

| | | | | |
|---|---|---|---|---|
| 9,004,631 | B1 | 4/2015 | Folkins et al. | |
| 2005/0062793 | A1* | 3/2005 | Takagi | B41J 2/165<br>347/29 |
| 2019/0275799 | A1* | 9/2019 | Shimazaki | B41J 2/16526 |

* cited by examiner

INKJET REUSABLE JETTING SHEET WITH CLEANING STATION

BACKGROUND

Systems and methods herein generally relate to inkjet printers and more particularly to inkjet printers using reusable jetting sheets.

On aqueous inkjet printers, various sheet sizes are used for printing jobs. A maximum print zone exists, as limited by the physical footprint of the inkjet printheads. For example, when one is printing legal size documents, long edge feed, with a relatively full image, all jets on the printheads (e.g., the maximum print zone) could be used. However, if one uses a smaller size sheet or uses a short edge feed, there could be jets that will not experience any ink movement for a particularly long time, depending on the length of the job being printed.

As a result, unused jets can develop a viscous fluid that blocks the jets, causing missing jets if the next job requires these previously unused jets. Thus, nozzles of inkjet printheads routinely clog when such are unused for extended periods, for example when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). To mitigate, uses often run print head maintenance processes that perform maintenance jetting from the heads onto sacrificial sheets. However, print head maintenance processes can be a waste of consumables, as well as a productivity detractor.

If the clogged nozzle condition goes uncorrected, it can lead to intermittent firing and the jet can eventually cease firing, and such a situation can be unrecoverable resulting in irreversible printhead damage. Therefore, maintaining clog free printheads provides greater longevity to the printheads. Depending on the pre-condition of the head, the time scale for onset of such unrecoverable failure could range from a few hours to days.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by jetting and cleaning cycles.

SUMMARY

Various apparatuses (such as printing devices) herein include, among other components, one or more inkjet printheads (each having a set of jets or nozzles), a reusable jetting sheet (e.g., a flexible material) that is adjacent to the set of nozzles, support structures (e.g., drive rollers) contacting the sheet and around which portions of the reusable jetting sheet are wound, and a cleaning station contacting the sheet. The reusable jetting sheet includes an opening, that is at least as large as the set(s) of nozzles, and a jetting area spaced from the opening (the jetting area includes an area of unbroken continuous surface of the sheet).

The support structures are adapted to move the reusable jetting sheet relative to the set of nozzles. More specifically, the support structures can include one or more drive rollers adapted to rotate to wind and unwind the reusable jetting sheet on and off the drive rollers to move the reusable jetting sheet relative to the set of nozzles (to, for example, alternately position the opening or the jetting area adjacent to the nozzles).

The inkjet printhead is adapted to eject ink from at least some of the nozzles, through the opening, to print media when the opening is positioned adjacent to the set of nozzles to print on print media. Therefore, the opening is at least as large as an area occupied by all sets of nozzles. The inkjet printhead is further adapted to eject ink from at least some of the nozzles to the jetting area when the jetting area is positioned adjacent to the set(s) of nozzles.

The cleaning station is positioned, relative to the reusable jetting sheet and the set of nozzles, to contact and clean the jetting area when the opening is adjacent to the set of nozzles. The cleaning station includes a cleaning roller that contacts the reusable jetting sheet and is adapted to remove jetted ink from the jetting area. The cleaning station can also include a container that is adjacent to the cleaning roller. At least a portion of the cleaning roller can be positioned within the container, and the container is adapted to maintain cleaning fluid in contact with the cleaning roller.

Various methods herein perform steps including, but not limited to, controlling, using a controller of a printing apparatus, the support structures to move the reusable jetting sheet relative to the sets of nozzles (of the inkjet printhead of the printing apparatus) to position either the opening or the jetting area of the reusable jetting sheet adjacent to the sets of nozzles. When controlling the support structures, the methods herein rotate drive rollers to wind and unwind the reusable jetting sheet on and off the drive rollers so as to move the reusable jetting sheet relative to the set of nozzles. Further, such methods control, using the controller, the inkjet printhead to eject ink from at least some of the nozzles, through the opening, to print media to perform printing on the print media when the opening is adjacent to the nozzles.

Also, these methods control, using the controller, the support structures to move the reusable jetting sheet relative to the sets of nozzles to position the jetting area of the reusable jetting sheet adjacent to the sets of nozzles and control, using the controller, the inkjet printhead to eject ink from the sets of nozzles to the jetting area to perform maintenance jetting from at least some of the nozzles.

Such methods can also control, using the controller, the cleaning roller to remove jetted ink from the jetting area when the process of controlling the support structure simultaneously positions the opening adjacent to the set of nozzles and positions the jetting area adjacent to the cleaning roller. These methods can also control, using the controller, the cleaning roller to rotate within the container that maintains the cleaning fluid, when controlling the cleaning roller to remove the jetted ink from the jetting area.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
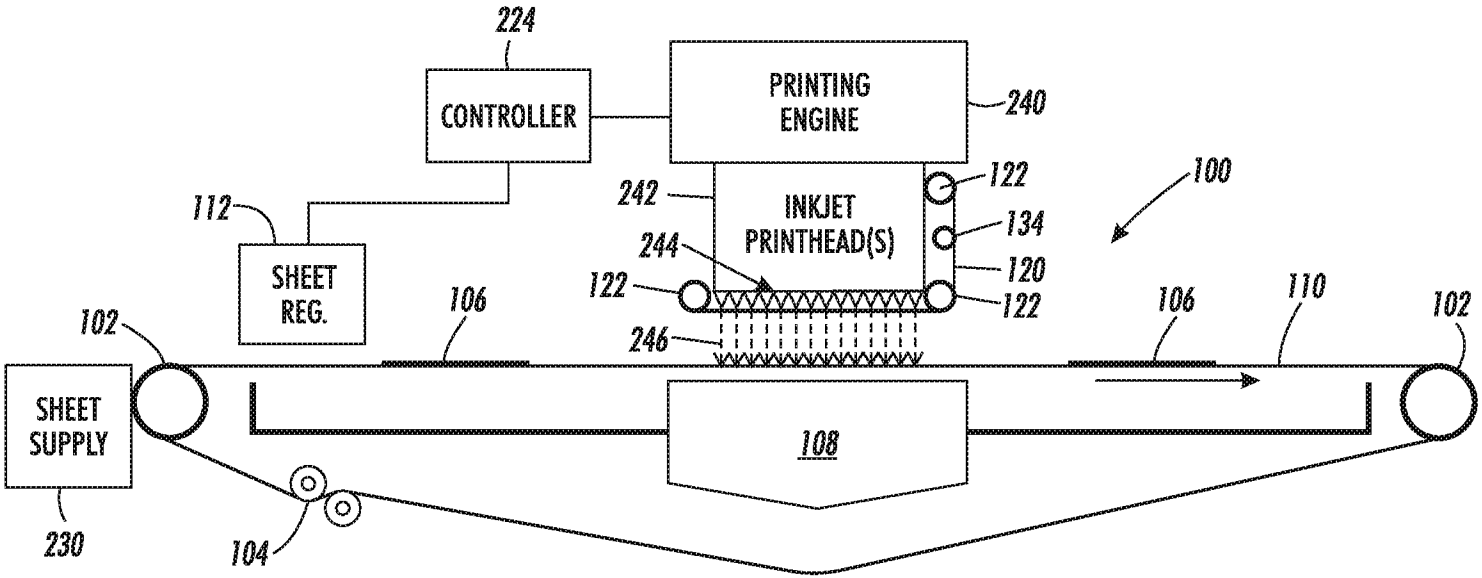
FIG. 1 is a side-view schematic diagram illustrating devices herein.

As mentioned above, nozzles of inkjet printheads routinely clog when such are unused for extended periods, such as when paper sizes or printing patterns do not regularly utilize all jets/nozzles in the maximum print zone. Jetting of the maximum print zone can be accomplished, for example, by using an elongated sacrificial jetting sheet (e.g., legal size paper) with the longest dimension oriented perpendicular to the processing direction (in the cross-processing orientation) to allow all nozzles in the maximum print zone to be jetted onto the cross-processing oriented legal size sheet. However, if one does not regularly print on elongated sheets, this could require users to unnecessarily devote a paper tray in the feeder solely to longer sheets, which may be inconvenient or uneconomical, especially if the user never prints on that size sheet. In view of this, devices and processes herein provide a reusable jetting sheet with a cleaning station.

Therefore, the systems and methods herein cover the printheads using a thin (e.g., rubber, etc.) reusable jetting sheet that has a (e.g., rectangular) opening to allow normal printing operations to be performed through the opening. Such an opening moves from the area of the printheads by wrapping the reusable jetting sheet on a roller (which can be driven by motor). This covers the printheads with the reusable jetting sheet so that the unused nozzles of the printhead can be jetted by ejecting ink droplets on the reusable sheet.

After the nozzles are jetted, the opening on the reusable jetting sheet is moved back to next to the printheads by rotating the rollers in the opposite direction, potentially using a constant force spring. The ink droplets jetted on to the reusable jetting sheet are cleaned from the reusable jetting sheet using cleaner roller. The cleaning roller rotates to wipe the ink and the surface of the cleaning roller is thereby cleaned by a sponge and flushing fluid.

Thus, structures and methods herein allow printhead jetting to be done at regular interval times, especially when printing print jobs narrow paper, and this prevents dried out and clogged jets/nozzles and helps recover missing jets. Also, this jetting can be controlled to occur only for nozzles that have not ejected ink for longer than a non-use time limit, or at specific reusable jetting sheet counts (e.g., after every N sheets). This non-use time limit can be different intervals for different type inks or different colors.

Therefore, with devices and methods herein, nozzles within the printheads can be selectively jetted only after an idle time period or reusable jetting sheet count (during which the nozzles do not eject the liquid ink) has expired, which can be different for different inks or colors, etc. Such can also be different on a nozzle-by-nozzle basis depending upon which nozzles were used or not used in recent print job operations (where, in print job operations, the ink is printed on print media in a pattern according to a print job to produce an item of printer output, which is contrasted with jetting printing, where the jetting ink is discarded after printing).

As shown, for example, in FIGS. 1 and 7, devices herein can be printing apparatuses that can include, among other components (as shown in FIG. 1) a media supply 230 storing print media, a media path 100 having a vacuum belt 110 having perforations between the belt edges 116, and a vacuum manifold 108 positioned adjacent (below) the vacuum belt 110 in a location to draw air through the perforations or openings. As shown in FIG. 1, the vacuum belt 110 is supported between rollers 102, at least one of which is driven, and the belt is kept under proper tension using tensioning rollers 104.

The generic media supply 230 shown in the drawings can include various elements such as a paper tray, feeder belts, alignment guides, etc., and such devices can store cut sheets, and transport the cut sheets of print media to the vacuum belt 110. Also, a print engine 240 is positioned adjacent the vacuum belt 110 in a location to receive sheets from the vacuum belt 110 to allow nozzles 244 in one or more printheads 242 to eject ink 246 on sheets of print media 106. Additionally, various sheet registration devices 112 are included to align the sheets of media before they reach the printheads 242. A processor/controller 224 is electrically connected to the printing engine 240, inkjet printheads 242, sheet registration devices 112, etc.

The side of the vacuum belt 110 where the manifold 108 is located is arbitrarily referred to herein as the "bottom" of the vacuum belt 110, or the area "below" the vacuum belt 110. Conversely, the side of the vacuum belt 110 where the printheads 242 are located is arbitrarily referred to herein as the "top" of the vacuum belt 110, or the area "above" the vacuum belt 110. However, despite these arbitrary designations, the device itself can have any orientation that is useful for its intended purpose. As shown in FIG. 1, the vacuum belt 110 is positioned adjacent the media supply 230 in a location to move the sheets of the print media from the media supply 230.

FIG. 1 also illustrates a reusable jetting sheet 120 (e.g., a flexible, durable material, such as rubbers, plastics, polymers, metals, alloys, etc.) that is adjacent to the set of nozzles 244. The reusable jetting sheet 120 is wound on and supported by support structures 122 (e.g., rollers) that contact the reusable jetting sheet 120. Also, a cleaning station 134 contacts the reusable jetting sheet 120 to clean jetted ink therefrom.

Figure 2:
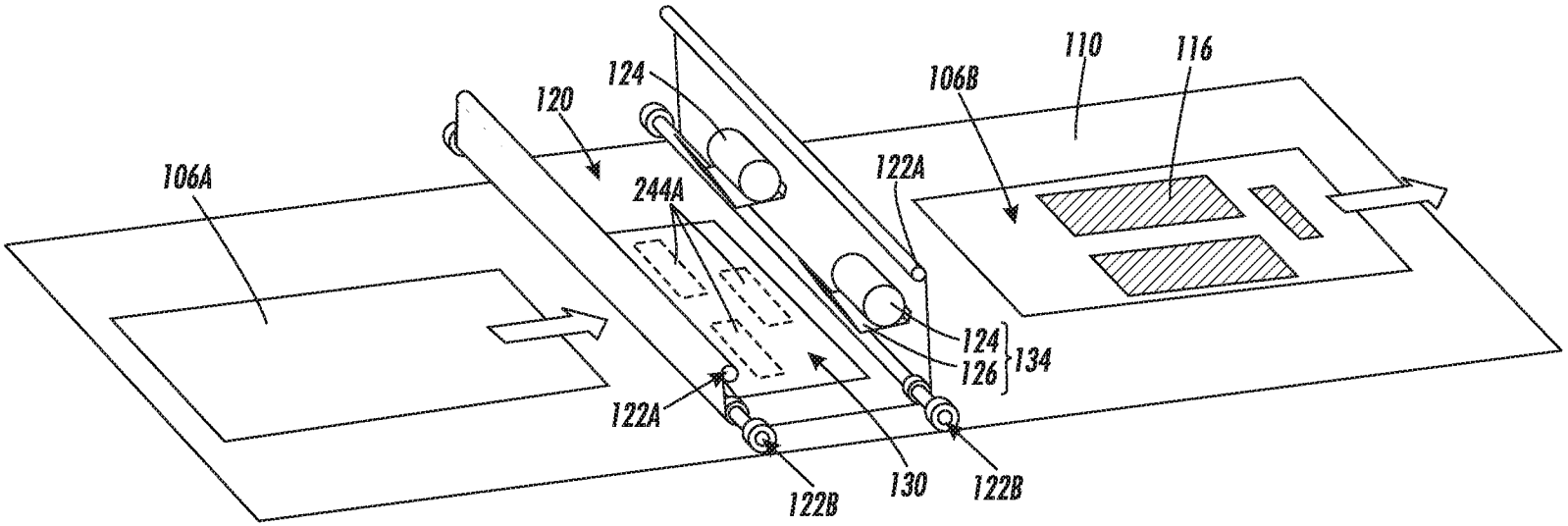
FIGS. 2-5 are perspective-view schematic diagram illustrating devices herein.

While FIG. 1 shows a side view of the media path 100, FIG. 2 is a schematic perspective view diagram illustrating a limited amount of the items shown in FIG. 1 to allow the reusable jetting sheet 120 to be more easily seen. As shown in FIG. 2, the reusable jetting sheet 120 includes an opening 130 through which printing occurs. The opening 130 is at least as large as the set(s) of nozzles 244, the locations of which are shown in FIG. 2 using broken-line boxes 244A. Therefore, the opening 130 is at least as large as an area occupied by all sets of nozzles 244A.

FIG. 2 shows that as blank sheets 106A are moved by the belt 110 past the nozzle locations 244A, the nozzles 244 eject ink 246 through the opening 130 onto the sheets 106 to produce printed sheets 106B having printed markings 116 thereon. Thus, the inkjet printheads 242 are adapted to eject ink 246 in a pattern specified by the print job from at least some of the nozzles 244, through the opening 130, to print media 106 when the opening 130 is positioned adjacent to the set of nozzles 244 to print markings 116 on the print media 106 in the pattern specified by the print job.

The support structures 122 are adapted to move the reusable jetting sheet 120 relative to the sets of nozzles 244. More specifically, the support structures 122 can include drive rollers 122A and idler rollers 122B. For example, the drive rollers 122A can include motors and/or constant force springs. Thus, one of the driver rollers 122A can be motor driven and cause a spring within an opposing drive roller 122A to wind and accumulate spring force (which keeps tension on the reusable jetting sheet 120). Release of the drive motor allows the accumulated spring force to return the rollers to a previous position while constantly maintaining tension on the reusable jetting sheet 120. The drive rollers 122A are controlled by the controller 224 to perform such actions.

FIG. 2 also illustrates that the cleaning station 134 includes a cleaning roller 124 and a container 126 that is adjacent to the cleaning roller 124. At least a portion of the cleaning roller 124 is positioned within the container 126, and the container 126 is adapted to maintain cleaning fluid in contact with the cleaning roller 124. The cleaning roller 124 rotates in the cleaning fluid within the container 126 to use the cleaning fluid when performing cleaning operations.

Figure 3:
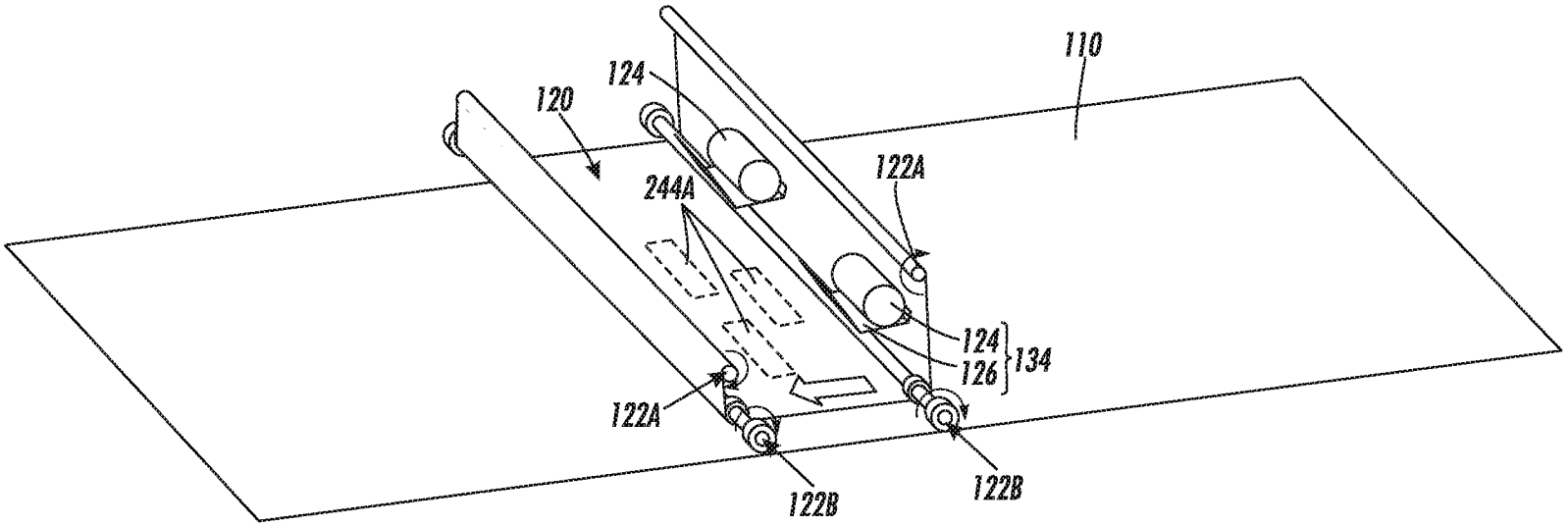

The drive rollers 122A are adapted to rotate to wind and unwind the reusable jetting sheet 120 on and off the drive rollers 122A, and this moves the reusable jetting sheet 120 relative to the set of nozzles 244 to, for example, position either the opening 130 or the jetting area 128 adjacent to the nozzles 244. For example, as shown in FIG. 3, rotation of the driver rollers 122A winds the opening 130 onto one of the drive rollers 122A, which aligns the locations of the nozzles 244A with an area of unbroken continuous surface of the reusable jetting sheet 120, which is sometimes referred to herein as a jetting area 128 (shown in FIG. 4 using broken lines, while jetted ink 246 is shown as shaded items 246 within the jetting areas 128).

Figure 4:
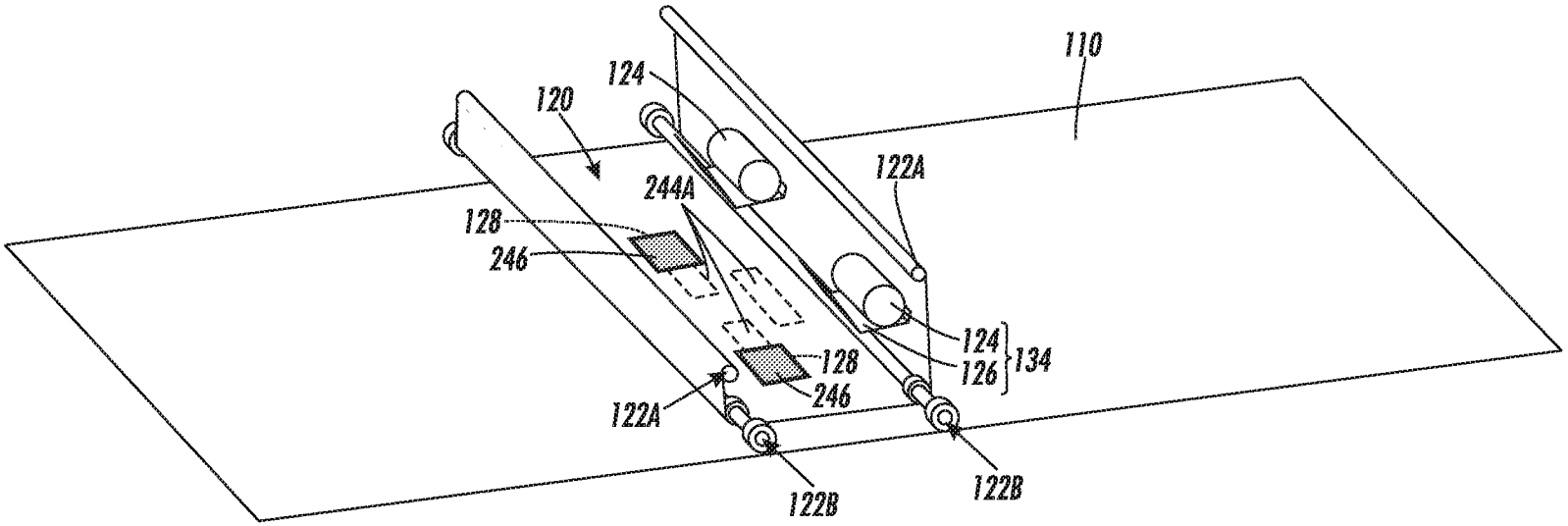

Thus, as shown in FIG. 4, the jetting area 128 of the reusable jetting sheet 120 is spaced from (at a distance from or at a different location from) the opening 130. As also shown in FIG. 4, the inkjet printhead 242 is further adapted to eject ink 246 from at least some of the nozzles 244 to the jetting area 128 when the jetting area 128 is positioned adjacent to locations of the sets of nozzles 244A. Again, jetting can be controlled to occur from all nozzles 244 simultaneously, can be controlled to occur only from nozzles 244 that have not ejected ink 246 for longer than a non-use time limit, or at specific reusable jetting sheet counts (e.g., after every N sheets 106).

As shown in FIG. 4, the ink 246 is cleaned from the jetting area 128 at the cleaning station 134. More specifically, as shown the cleaning station 134 is positioned, relative to the reusable jetting sheet 120 and the location of the sets of nozzles 244A, to contact the jetting area 128 when the opening 130 is adjacent to the location of the sets of nozzles 244A.

Figure 5:
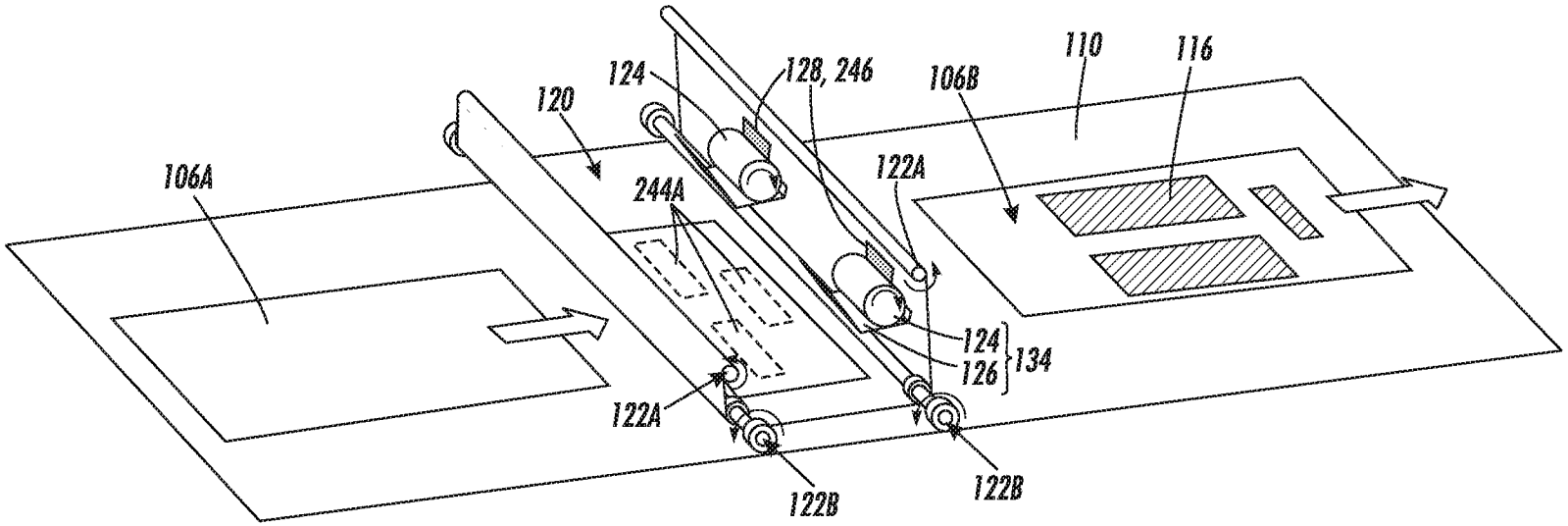

As shown in FIG. 5, the cleaning roller 124 contacts the jetting area 128 of the reusable jetting sheet 120 and rotates through the cleaning fluid in the container 126 to remove jetted ink 246 from the jetting area 128. As also shown in FIG. 5, printing markings 116 can be ejected through the opening 130 to the print media 106 simultaneously while the jetting area 128 of the reusable jetting sheet 120 is being cleaned by the cleaning roller 124. After being cleaned, the jetting area 128 can be moved back next to the nozzles 124 to receive additional jetting ink 246. The jetting sheet 120 is potentially a permanent, non-replaceable component of the printer 204, or the jetting sheet 120 may be replaceable after many jetting/cleaning cycles (hundreds, thousands, etc.).

Figure 6:
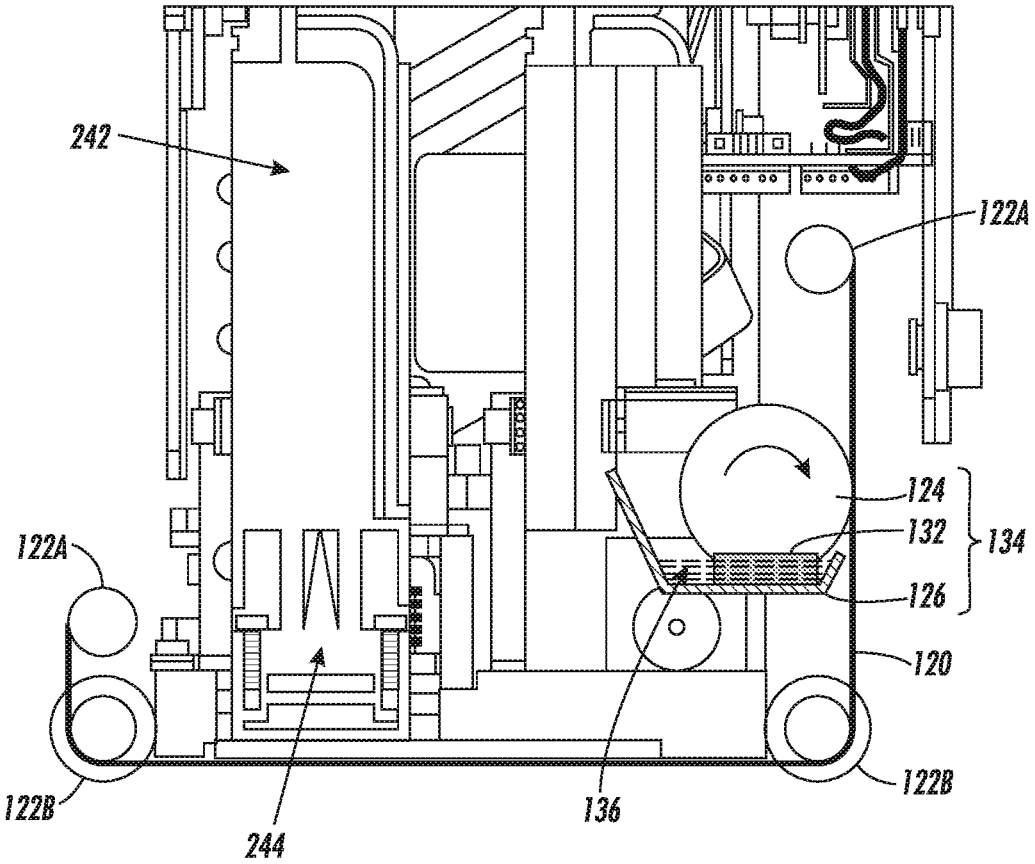
FIG. 6 is a side-view schematic diagram illustrating devices herein.

FIG. 6 is an expanded cross-sectional view of the previously described structure and shows the reusable jetting sheet 120 on the rollers 122, the printhead 242, nozzles 244, and cleaning station 134. Note that, as shown in FIG. 6, the cleaning station 134 can include a pad 132 submerged in the cleaning fluid 136 that contacts the cleaning roller 124 to aid in cleaning the ink 246 from the jetting area 128 of the reusable jetting sheet 120.

Figure 7:
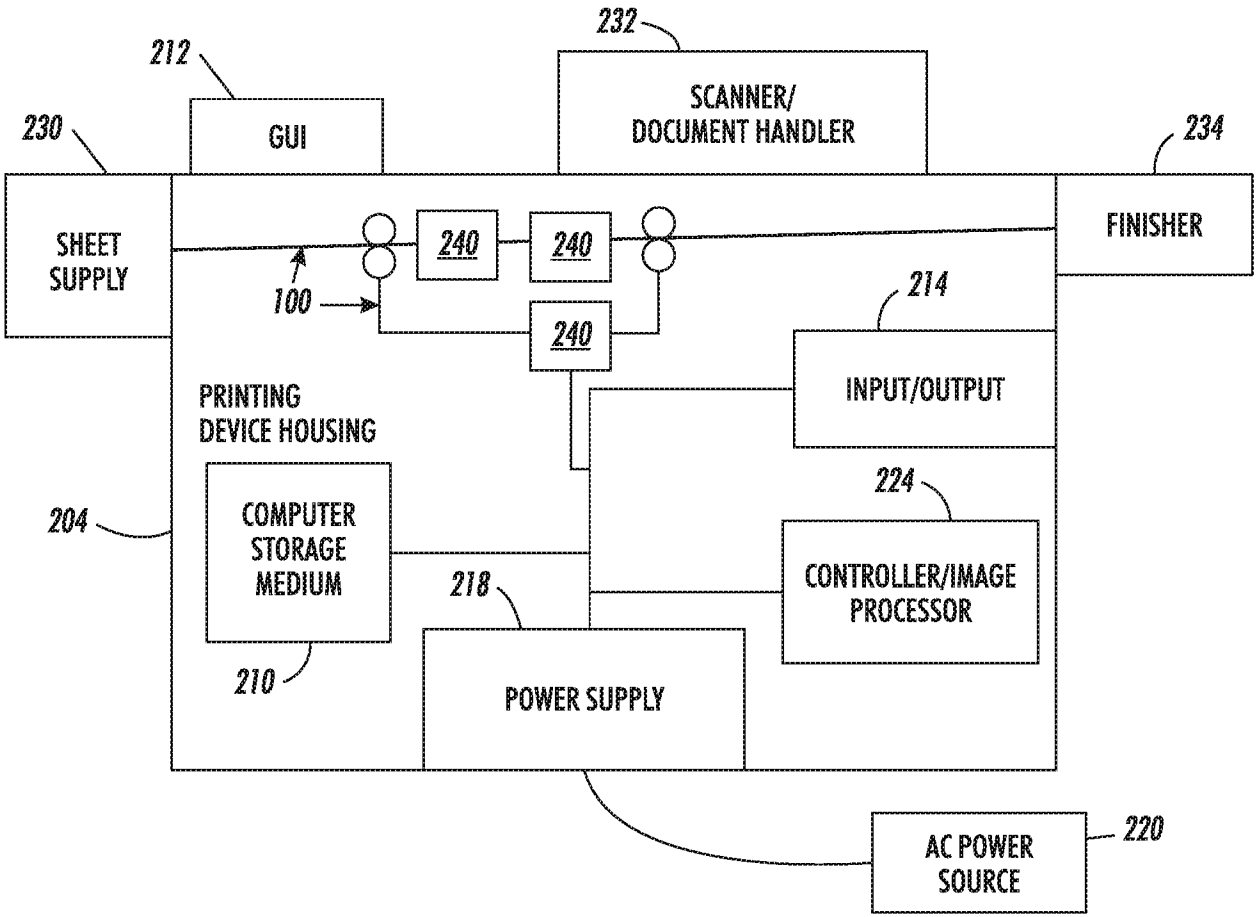
FIG. 7 is a schematic diagram illustrating devices herein.

FIG. 7 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 7 a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different from a general purpose computer because it is specialized for processing image data), a media path 236 positioned to supply continuous media or sheets of media from a reusable sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future.

Figure 8:
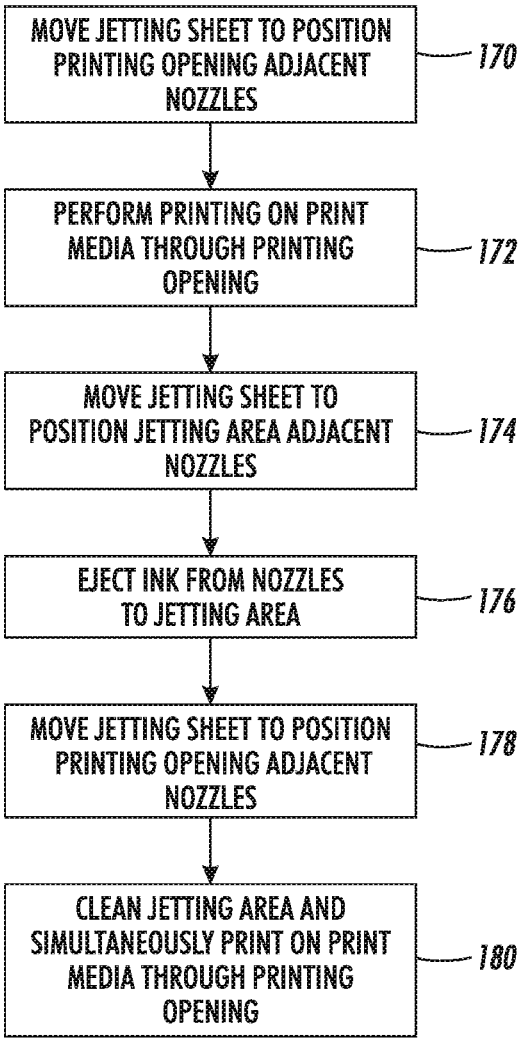
FIG. 8 is a flow diagram of various methods herein.

FIG. 8 is flowchart illustrating exemplary methods herein. In item 170, these methods control, using the controller, the support structures to move the reusable jetting sheet relative to the sets of nozzles (of the inkjet printhead of the printing apparatus) to position the opening or the jetting area of the reusable jetting sheet adjacent to the sets of nozzles. When controlling the support structures in item 170, the methods herein rotate drive rollers to wind and unwind the reusable jetting sheet on and off the drive rollers so as to move the reusable jetting sheet relative to the set of nozzles. Further, in item 172, such methods control, using the controller, the inkjet printhead to eject ink from at least some of the nozzles, through the opening, to print media to perform printing on the print media as specified by a print job.

Also, in item 174, these methods control, using the controller, the support structures to move the reusable jetting sheet relative to the sets of nozzles to position the jetting area of the reusable jetting sheet adjacent to the sets of nozzles. Then, in item 176, these methods control, using the controller, the inkjet printhead to eject ink from the sets of nozzles to the jetting area to perform maintenance jetting from at least some of the nozzles. Following this, in item 178, these methods control, using the controller, the support structures to again move the reusable jetting sheet relative to the sets of nozzles to again position the opening in the reusable jetting sheet adjacent to the sets of nozzles, which positions the opening adjacent to the set of nozzles and simultaneously positions the jetting area adjacent to the cleaning roller.

In item 180, such methods can also control, using the controller, the cleaning roller to remove jetted ink from the jetting area. Further, in item 180 printing on print media can also be simultaneously performed because the process of controlling the support structure simultaneously positions the opening adjacent to the set of nozzles and positions the jetting area adjacent to the cleaning roller. These methods also control, using the controller, the cleaning roller to rotate within the container that maintains the cleaning fluid, when controlling the cleaning roller to remove the jetted ink from the jetting area in item 180. Such processing is repeated each time jetting is needed, using the same reusable jetting sheet and without changing the jetting sheet.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

an inkjet printhead having a set of nozzles;

a reusable jetting sheet adjacent to the set of nozzles;

support structures contacting the reusable jetting sheet; and a cleaning roller contacting the reusable jetting sheet, wherein the reusable jetting sheet comprises:

an opening at least as large as the set of nozzles; and a jetting area spaced from the opening, wherein the support structures are adapted to move the reusable jetting sheet relative to the set of nozzles, wherein the inkjet printhead is adapted to eject ink from ones of the set of nozzles, through the opening, to print media when the opening is positioned adjacent to the set of nozzles, wherein the inkjet printhead is adapted to eject ink from ones of the set of nozzles to the jetting area when the jetting area is positioned adjacent to the set of nozzles, and wherein the cleaning roller is positioned, relative to the reusable jetting sheet and the set of nozzles, to contact the jetting area when the opening is adjacent to the set of nozzles.

2. The apparatus according to claim 1, wherein the cleaning roller is positioned to remove jetted ink from the jetting area.

3. The apparatus according to claim 1, further comprising a container adjacent to the cleaning roller, wherein at least a portion of the cleaning roller is positioned within the container, and wherein the container is adapted to maintain cleaning fluid in contact with the cleaning roller.

4. The apparatus according to claim 1, wherein the support structures comprise drive rollers adapted to rotate to wind and unwind the reusable jetting sheet on and off the drive rollers to move the reusable jetting sheet relative to the set of nozzles.

5. The apparatus according to claim 1, wherein the jetting area comprises an area of unbroken continuous surface of the reusable jetting sheet.

6. The apparatus according to claim 1, wherein the reusable jetting sheet comprises a flexible material.

7. The apparatus according to claim 1, wherein the inkjet printhead comprises a plurality of inkjet printheads, each having a set of nozzles, and wherein the opening is at least as large as an area occupied by all sets of nozzles.

8. An apparatus comprising:

an inkjet printhead having a set of nozzles;

a reusable jetting sheet adjacent to the set of nozzles;

support structures contacting the reusable jetting sheet; and a cleaning station contacting the reusable jetting sheet, wherein the reusable jetting sheet comprises:

an opening at least as large as the set of nozzles; and a jetting area spaced from the opening, wherein the support structures are adapted to move the reusable jetting sheet relative to the set of nozzles, wherein the inkjet printhead is adapted to eject ink from ones of the set of nozzles, through the opening, to print media when the opening is positioned adjacent to the set of nozzles, and wherein the inkjet printhead is adapted to eject ink from ones of the set of nozzles to the jetting area when the jetting area is positioned adjacent to the set of nozzles, and wherein the cleaning station is positioned, relative to the reusable jetting sheet and the set of nozzles, to contact and clean the jetting area when the opening is adjacent to the set of nozzles.

9. The apparatus according to claim 8, wherein the cleaning station is positioned to remove jetted ink from the jetting area.

10. The apparatus according to claim 8, wherein the cleaning station comprises a container adjacent to a cleaning roller, wherein at least a portion of the cleaning roller is positioned within the container, and wherein the container is adapted to maintain cleaning fluid in contact with the cleaning roller.

11. The apparatus according to claim 8, wherein the support structures comprise drive rollers adapted to rotate to wind and unwind the reusable jetting sheet on and off the drive rollers to move the reusable jetting sheet relative to the set of nozzles.

12. The apparatus according to claim 8, wherein the jetting area comprises an area of unbroken continuous surface of the reusable jetting sheet.

13. The apparatus according to claim 8, wherein the reusable jetting sheet comprises a flexible material.

14. The apparatus according to claim 8, wherein the inkjet printhead comprises a plurality of inkjet printheads, each having a set of nozzles, and wherein the opening is at least as large as an area occupied by all sets of nozzles.

15. A method comprising:

controlling, using a controller of a printing apparatus, support structures to move a reusable jetting sheet relative to a set of nozzles of an inkjet printhead of the printing apparatus to position an opening in the reusable jetting sheet adjacent to the set of nozzles;

controlling, using the controller, the inkjet printhead to eject ink from ones of the set of nozzles, through the opening, to print media to perform printing on the print media;

controlling, using the controller, the support structures to move the reusable jetting sheet relative to the set of nozzles to position a jetting area of the reusable jetting sheet adjacent to the set of nozzles;

controlling, using the controller, the inkjet printhead to eject ink from the set of nozzles to the jetting area to perform maintenance jetting from ones of the set of nozzles; and controlling, using the controller, a cleaning roller to remove jetted ink from the jetting area when the controlling of the support structures simultaneously positions the opening adjacent to the set of nozzles and positions the jetting area adjacent to the cleaning roller.

16. The method according to claim 15, further comprising controlling, using the controller, the cleaning roller to rotate within a container maintaining cleaning fluid when controlling the cleaning roller to remove the jetted ink from the jetting area.

17. The method according to claim 15, wherein the controlling the support structures comprises rotating drive rollers to wind and unwind the reusable jetting sheet on and off the drive rollers to move the reusable jetting sheet relative to the set of nozzles.

18. The method according to claim 15, wherein the jetting area comprises an area of unbroken continuous surface of the reusable jetting sheet.

19. The method according to claim 15, wherein the reusable jetting sheet comprises a flexible material.

* * * * *